US006612892B1

(12) United States Patent
Lamouri et al.

(10) Patent No.: US 6,612,892 B1
(45) Date of Patent: Sep. 2, 2003

(54) HIGH INTENSITY DISCHARGE LAMPS, ARC TUBES AND METHODS OF MANUFACTURE

(75) Inventors: Abbas Lamouri, Fairview Park, OH (US); Juris Sulcs, Chagrin Falls, OH (US); Yongyei Gu, Solon, OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 09/800,669

(22) Filed: Mar. 8, 2001

(51) Int. Cl.[7] ..... H01J 9/32; H01J 9/38
(52) U.S. Cl. ..... 445/26; 445/40; 445/43
(58) Field of Search ..... 445/40, 41, 26, 445/43

(56) References Cited

U.S. PATENT DOCUMENTS 4,799,912 A * 1/1989 Salgo ..... 445/26
5,108,333 A 4/1992 Heider et al.
5,176,558 A * 1/1993 Newell ..... 445/26
5,505,648 A 4/1996 Nagasawa et al.
6,368,175 B1 * 4/2002 Horiuchi et al. ..... 313/636
6,411,037 B1 * 6/2002 Ohkawai et al. ..... 313/623

OTHER PUBLICATIONS

Hansler and Davenport, Journal of the Illuminating Engineering Society, pp. 109–120, Fall, 1985.

* cited by examiner

*Primary Examiner*—Kenneth J. Ramsey
(74) *Attorney, Agent, or Firm*—Duane Morris, LLP

(57) ABSTRACT

A tipless arc tube for a high intensity discharge lamp and method of manufacture wherein the arc tube may remain open to an uncontrolled atmosphere during the step of hermetically scaling the arc tube. The novel arc tube and method obviate the need to perform any process steps within a controlled atmosphere. The pressure of the fill gas sealed within the arc tube may be controlled by controlling the temperature of the fill gas during the step of hermetically sealing the arc tube. The novel arc tube and method obviate the need to use a pump to control the fill gas pressure.

79 Claims, 14 Drawing Sheets

HIGH INTENSITY DISCHARGE LAMPS, ARC TUBES AND METHODS OF MANUFACTURE

BACKGROUND OF THE INVENTION

The present invention generally relates to high intensity discharge ("HID") lamps, arc tubes, and methods of manufacture.

HID lamps such as metal halide and mercury lamps have found widespread use in lighting large outdoor and indoor areas such as athletic stadiums, gymnasiums, warehouses, parking facilities, and the like, because of the relatively high efficiency, compact size, and low maintenance of HID lamps when compared to other lamp types. Metal halide lamps are often preferred because of the efficiency of such lamps in producing white light.

HID lamps include an arc tube supported within an outer lamp envelope. The arc tube comprises a generally tubular body of light transmissive material such as quartz or ceramic material which forms a hermetically sealed light emitting chamber containing the lamp fill material and an inert fill gas. Generally, there are several types of arc tube bodies for HID lamps. One type of arc tube body is a "cylindrical" body formed from quartz tubing having the diameter of the generally cylindrical arc tube chamber in which the chamber is formed by pinch-sealing the end portions of the tubing. Another type of arc tube body is a "formed" body which is formed from quartz tubing of a much smaller diameter in which a bulbous light emitting chamber is formed by expansion under internal pressure between two end portions having the much smaller diameter of the tubing. The aforementioned types of arc tube bodies are used in forming "double-ended" arc tubes, i.e. arc tubes having spaced apart electrodes with one sealed at each end. The arc tubes for HID lamps may also be "single-ended" arc tubes having a bulbous chamber sealed at its only end.

An arc tube includes a pair of spaced apart electrodes between which the arc is established during operation of the lamp. In a double-ended arc tube, an electrode lead assembly is sealed in each end portion of the arc tube. The electrode lead assembly typically comprises a tungsten electrode, a molybdenum foil, and an outer molybdenum lead.

In the manufacture of double-ended arc tubes for HID lamps, either cylindrical body or formed body arc tubes, the light emitting chamber is sealed by positioning the electrode lead assemblies in each end portion of the arc tube body, heating a portion of each end portion, and then shrinking or pinching the heated portion around the electrode lead assembly positioned therein to thereby fix the position of the assembly relative to the arc tube body and to form a hermetic seal. The temperature of the heated portions typically reaches about 2000° C. or more. At these high temperatures, the metallic components of the electrode lead assembly positioned within the end portion are highly susceptible to corrosion when exposed to an uncontrolled atmosphere such as the air surrounding a factory production line, and any corrosion may significantly degrade the performance of the lamp and possibly lead to the mechanical failure of the lead assembly. Thus it is important to avoid exposure of the electrode lead assemblies to an uncontrolled atmosphere when the temperature of the assemblies is elevated during the manufacturing process.

In the context of the present invention, an "uncontrolled atmosphere" is any atmosphere other than one in which the composition of the atmosphere is strictly controlled such as the atmosphere in a glove box. The atmosphere surrounding a factory production line is considered to be an uncontrolled atmosphere even though there may be some control of the temperature, humidity, particulate content etc. of the atmosphere.

In the manufacture of HID lamps, the light emitting chamber of the arc tube body is dosed with solid lamp fill material such as one or more metal halides. This material is susceptible to moisture contamination when exposed to an uncontrolled atmosphere which significantly degrades the performance of the lamp. Thus in the manufacturing process, it is also important to avoid exposure of the solid lamp fill material to contaminating atmospheres.

In a known method of making arc tubes for HID lamps, an arc tube body is formed from vitreous material such as quartz. A fill/exhaust tube is then fused near the longitudinal center of the body where the light emitting chamber will be formed. The exhaust tube provides a means for communication between the interior of the chamber and the exterior of the arc tube body. The electrode lead assemblies are positioned and then pinch-sealed in the end portions of the arc tube body. During the pinch-sealing process, anon-reactive gas is introduced into the chamber through the fill/exhaust tube to prevent the exposure of the metallic components of the electrode lead assemblies to air when the components are heated during the sealing process, to thereby prevent corrosion of the metallic components. In the context of this invention, a "non-reactive" gas is a gas which is non-reactive with respect to the lamp components including, for example, the electrode lead assemblies and lamp fill material.

Once the ends of the arc tube body are sealed, the solid fill material and mercury are introduced into the chamber through the fill/exhaust tube. An inert fill gas is then introduced into the chamber at the desired fill pressure and the fill/exhaust tube is fused closed to thereby hermetically seal the chamber.

This prior art method suffers from several disadvantages including the substantial disadvantage that the chamber wall includes an irregularity at the point where the fill/exhaust tube was attached and then fused closed and tipped off. This irregularity may cause a cold spot on the wall of the chamber where halides will condense during operation of the lamp, and the condensation of halides may have a significant effect on the color uniformity of the light emitted from the lamp. The irregularity in the chamber may also disturb the light emitted from the chamber and the condensed halides may create shadows, making it difficult to control and direct the light. This is especially undesirable in optical systems such as fiber optics, projection display, and automotive headlamps. These disadvantages have a greater detrimental effect on lower wattage lamps which are smaller and where the irregularity includes a greater portion of the chamber wall.

A further disadvantage of the arc tube having a fused closed fill/exhaust tube applies to arc tubes mounted within a protective shroud or within tubular outer envelopes. The portion of the fill/exhaust tube which has been fused closed protrudes radially from the chamber wall of the arc tube. Thus a cylindrical shroud or tubular envelope must be of a larger diameter to envelope an arc tube with a radially protruding tip.

The prior art has developed methods of making "tip-less" arc tubes to obviate the deficiencies of the arc tube having a fused closed fill/exhaust tube. However, the prior art methods of making tipless arc tubes require the use of a controlled environment during at least some of the process steps.

Generally, the known methods of making tipless arc tubes include the steps of providing an arc tube body; positioning and then sealing an electrode lead assembly in one end portion of the arc tube body; introducing the solid lamp fill material and an inert fill gas into the interior of the body through the remaining open end portion of the body; and positioning and then sealing another electrode lead assembly in the remaining open end portion of the body to thereby form a hermetically sealed light emitting chamber.

To prevent oxidation of the metallic components of the first electrode lead assembly during the sealing process of the first end portion, it is known to introduce a non-reactive gas into the interior of the body through the other end portion to thus create a flow of non-reactive gas past the lead assembly during the sealing process. This prevents exposure of the metallic components to a reactive atmosphere such as moisture laden air during the sealing process. The non-reactive gas is commonly introduced into the interior of the body by conventional means such as fitting a hose over the end of the open end portion or inserting a probe into the interior of the body through the open end portion.

The interior of the body is then filled with a non-reactive gas through the open end portion prior to the introduction of the solid lamp fill material. The lamp fill material is typically stored in a dry non-reactive atmosphere and thus may be introduced into the interior of the body without contamination.

To prevent oxidation of the metallic components of the second electrode lead assembly during the sealing process of the second end portion, the prior art teaches that the interior of the arc tube body must be isolated from an uncontrolled atmosphere once the solid fill material and mercury are introduced into the interior of the arc tube body and the second electrode lead assembly is positioned in the remaining open end portion.

The prior art teaches that the interior of the arc tube may be isolated from an uncontrolled atmosphere by either (i) placing the arc tube body in a controlled atmosphere such as a glove box as taught in U.S. Pat. No. 5,108,333 to Heider et al. dated Apr. 28, 1992 or (ii) connecting the open end to a vacuum system which provides the necessary seal as taught in U.S. Pat. No. 5,505,648 to Nagasawa et al. dated Apr. 9, 1996. As illustrated by the prior art, one end portion of the arc tube body must be long enough to enclose the entire electrode lead assembly when the assembly is positioned within the end portion. Once the arc tube is isolated, the arc tube body is filled with the inert fill gas at the desired pressure and then the end portion is fused closed to the outside of the electrode lead assembly to enclose the entire assembly within the body. The arc tube may then be removed from the glove box or vacuum system and the second end portion is sealed by shrinking or pinching, after which the excess portion of the end portion may be removed to expose the outer lead of the electrode lead assembly.

The prior art methods suffer from the significant disadvantage of the requirement for isolating the arc tube body from the uncontrolled atmosphere. This has generally required the use of a glove box or vacuum system. Such methods are complex and difficult to automate.

Accordingly, it is an object of the present invention to obviate many of the deficiencies of the prior art and provide a novel HID lamp, arc tube and method of making arc tubes.

It is another object of the present invention to provide a novel arc tube and method of making arc tubes for HID lamps which obviates the need to perform any process steps within a controlled atmosphere.

It is a further object of the present invention to provide a novel arc tube and method of making tipless arc tubes for HID lamps in which the arc tube remains open to an uncontrolled atmosphere during the step of finally sealing the arc tube.

It is yet another object of the present invention to provide a novel arc tube and method of making tipless arc tubes for HID lamps in which communication of an inert fill gas with an uncontrolled atmosphere such as air is maintained until the arc tube is hermetically sealed.

It is yet a further object of the present invention to provide a novel arc tube and method of making arc tubes for HID lamps which obviates the need to remove a portion of the end portion to expose the outer portion of the electrode lead assembly.

It is still another object of the present invention to provide a novel arc tube and method of making arc tubes for HID lamps in which each end portion of the arc tube body has substantially the same length as the end portions of the finished arc tube.

It is still a further object of the present invention to provide a novel apparatus for extending the tubular opening formed by the end portion of an arc tube body and method of making arc tubes for HID lamps.

It is often desirable to obtain a final fill gas pressure which is significantly below atmospheric pressure at substantially room temperature, i.e., pressures below 500 torr. Final fill gas pressures below about one-half atmosphere are common and may be as low as about 30 torr. A fill pressure of about 100 torr is common in metal halide lamps. In order to obtain such final subatmospheric fill pressures, the prior art uses mechanical means to evacuate the interior of the arc tube to the desired pressure prior to hermetically sealing the interior of the arc tube, i.e., by fusing closed the fill/exhaust tube or shrinking or pinching the remaining open end portion in a tipless arc tube. Such methods require the use of expensive pumps and/or vacuum systems, are complex, and difficult to automate.

The patent to Heider et al. discloses that a "slight" under-pressure of the fill gas may be obtained by heating the fill gas and fusing closed the open end portion within a glove box and then removing the arc tube from the glove box to shrink or pinch seal the remaining unpinched end portion. Heider et al. disclose raising the temperature of the fill gas by only 100° C. prior to fusing closed the arc tube to obtain a slight under-pressure when the fill gas cools. If the fill gas is heated at atmospheric pressure, a temperature differential of 100° C. will provide a final fill gas pressure of greater than 500 torr when the arc tube is sealed and cooled. There is no disclosure in Heider et al. that a significantly subatmospheric fill pressure, i.e., a pressure less than 500 torr, may be obtained by this process, or that the fill gas temperature may be controlled outside of a glove box while open to an uncontrolled atmosphere.

Accordingly, it is yet another object of the present invention to provide a novel arc tube and method of making arc tubes for HID lamps which obviates the need to mechanically evacuate the arc tube to obtain a significantly subatmospheric fill pressure.

It is still another object of the present invention to provide a novel arc tube and method of making arc tubes for HID lamps in which the temperature of the fill gas is controlled prior to sealing the arc tube in an uncontrolled atmosphere.

It is yet another object of the present invention to provide a novel arc tube and method of making arc tubes for HID lamps having significantly subatmospheric fill pressure in which there is no pressure differential at the time of sealing.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

The present invention finds utility in arc tubes for all types and sizes of HID lamps and methods of manufacture of such lamps generally. By way of example only, certain aspects of the present invention will be described in connection with tipless quartz formed body arc tubes for double-ended metal halide lamps.

Figure 1:
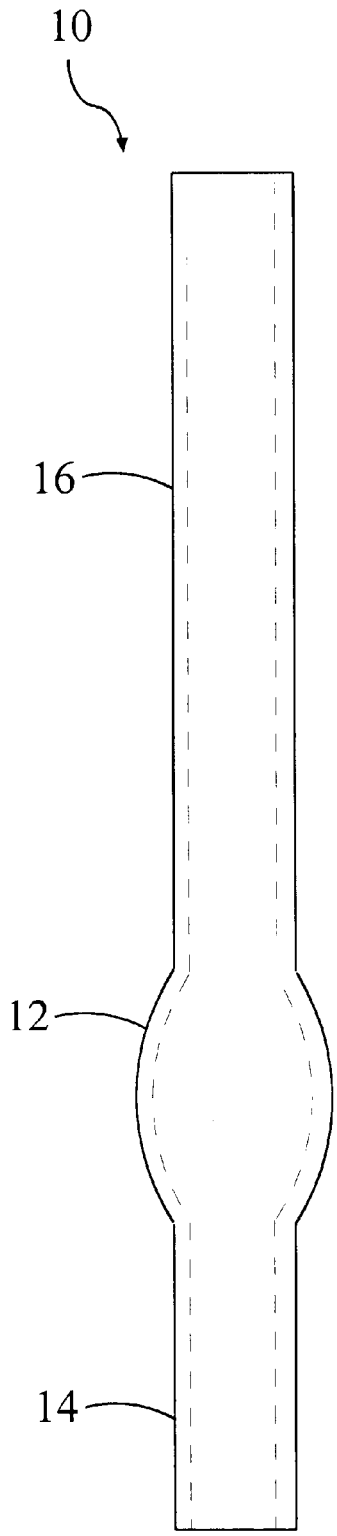
FIGURE 1 PRIOR ART
FIG. 1 is a cross-sectional view of an arc tube body having a bulbous light emitting chamber.

FIG. 1 illustrates a prior art arc tube body which has been formed from a quartz tube. The arc tube body 10 comprises a bulbous light emitting chamber 12 intermediate open tubular end portions 14,16. The arc tube body 10 may be formed using any suitable conventional method.

Figure 2A:
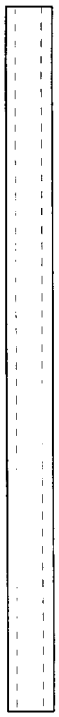
FIGURE 2A PRIOR ART
FIGS. 2*a–e* illustrate the prior art process steps for forming the arc tube body illustrated in FIG. 1.
Figure 2B:
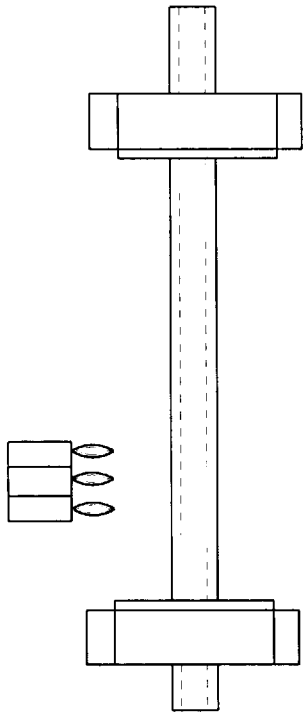
FIGURE 2B PRIOR ART
Figure 2C:
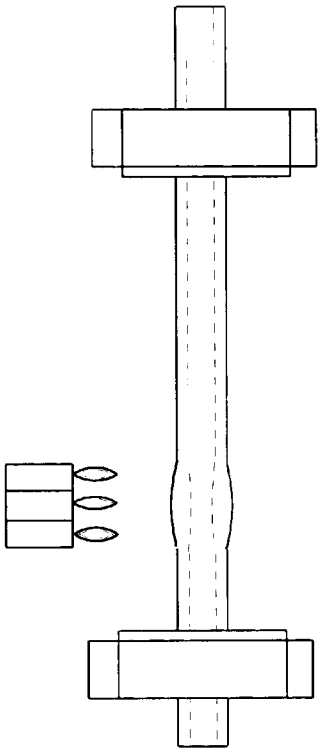
FIGURE 2C PRIOR ART
Figure 2D:
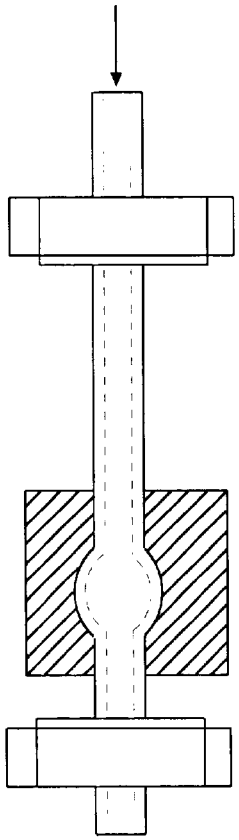
FIGURE 2D PRIOR ART
Figure 2E:
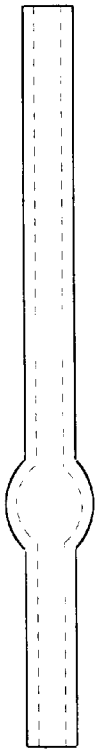
FIGURE 2E PRIOR ART

Formed body arc tubes may be manufactured in the manner described in the Lamouri et al. copending patent application Ser. No. 09/597,547 filed Jun. 19, 2000, and entitled "Horizontal Burning HID Lamps And Arc Tubes" assigned to the assignee of the present invention. FIGS. 2*a–e* illustrate such a method of forming arc tubes from quartz tubing (FIG. 2*a*) by loading the tubing on a lathe and heating the tubing (FIG. 2*b*), gathering the heated tube by axial movement of the tube (FIG. 2*c*), and expanding with internal pressure the gathered tube against a mold (FIG. 2*d*) to obtain the desired shape of the arc tube body (FIG. 2*e*). The thickness of the arc tube body may be adjusted by the amount of quartz accumulated in the gathering process and the shape of the arc tube body is determined by the shape of the mold.

Figure 3A:
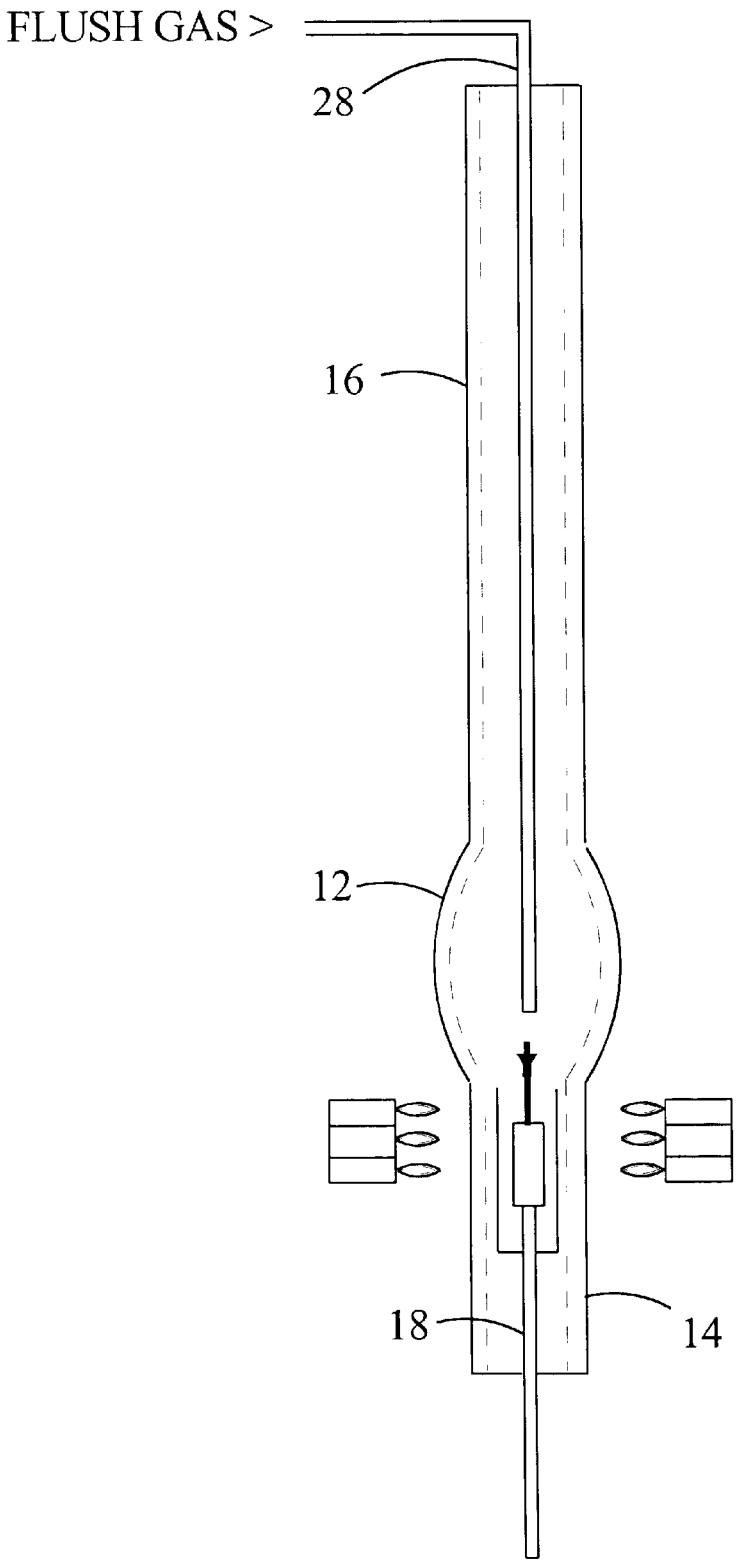
FIG. 3*a* illustrates the step of heating the end portion of an arc tube body while flushing the interior of the body with an inert gas during the pinch sealing process.
Figure 3B:
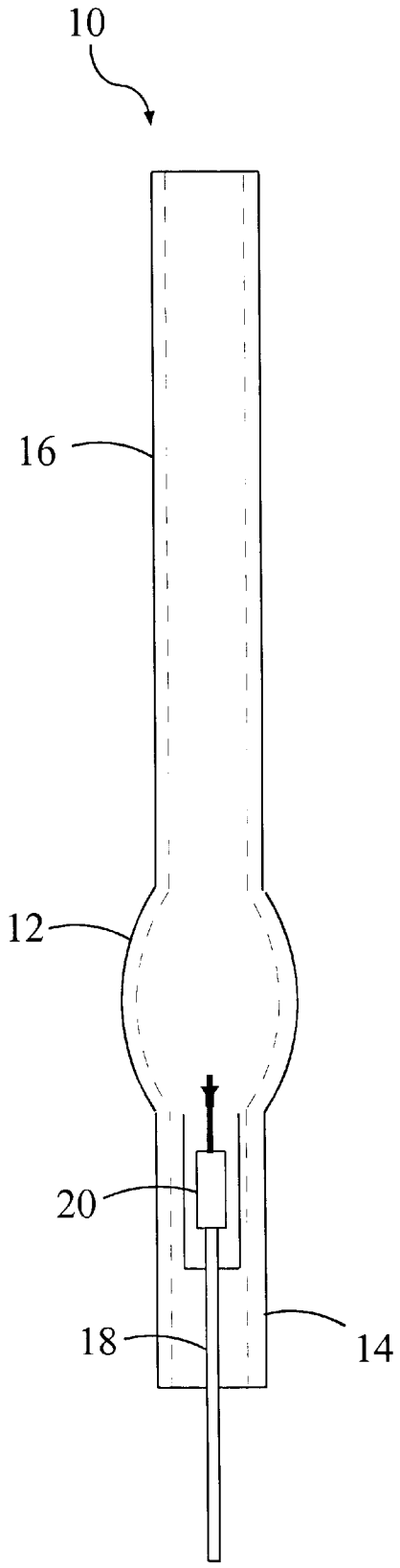
FIG. 3*b* is a cross-sectional view of an arc tube body having an electrode lead assembly pinch sealed in one end.

As shown in FIGS. 3*a* and 3*b*, a first electrode lead assembly 18 is positioned within the open tubular end portion 14 and the end portion 14 is sealed using a conventional pinch sealing process. During the pinch sealing process, a portion of the end portion 14 is heated to soften the quartz, and then the softened portion is pressed together and around the portion of the electrode lead assembly 18 positioned therein using conventional pinch jaws (not shown) forming pinch seal 20. The pinch seal 20 fixes the position of the assembly 18 relative to the arc tube body 10 and provides a hermetic seal between the interior of the chamber 12 and the exterior of the body 10 through the end portion 14.

Figure 4:
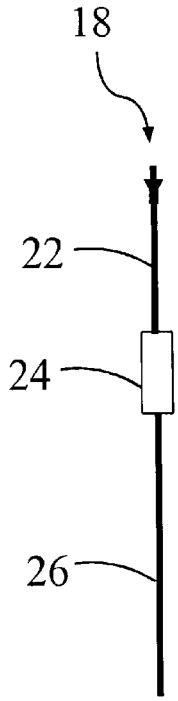
FIG. 4 is a schematic illustrating an electrode lead assembly.

The electrode lead assembly 18 may be a conventional lead assembly comprising several metallic components including a tungsten electrode 22, a molybdenum foil 24, and a molybdenum outer lead 26 as shown in FIG. 4. During the pinch sealing process, the metallic components may reach temperatures as high as 2000° C. or more when the quartz is softened. At such high temperatures, the metallic components are highly susceptible to corrosion if exposed to moisture in a reactive atmosphere such as air. To prevent such corrosion, an inert gas is introduced into the chamber 12 through the remaining open tubular end portion 16 and flows past the lead assembly 18 during the pinch sealing process. The gas may be introduced by any conventional means such as insertion of a probe 28 as shown in FIG. 3*a* or the connection of a hose (not shown) to the open end portion 16. The gas may be any inert gas such as nitrogen or argon or mixtures thereof.

Figure 5:
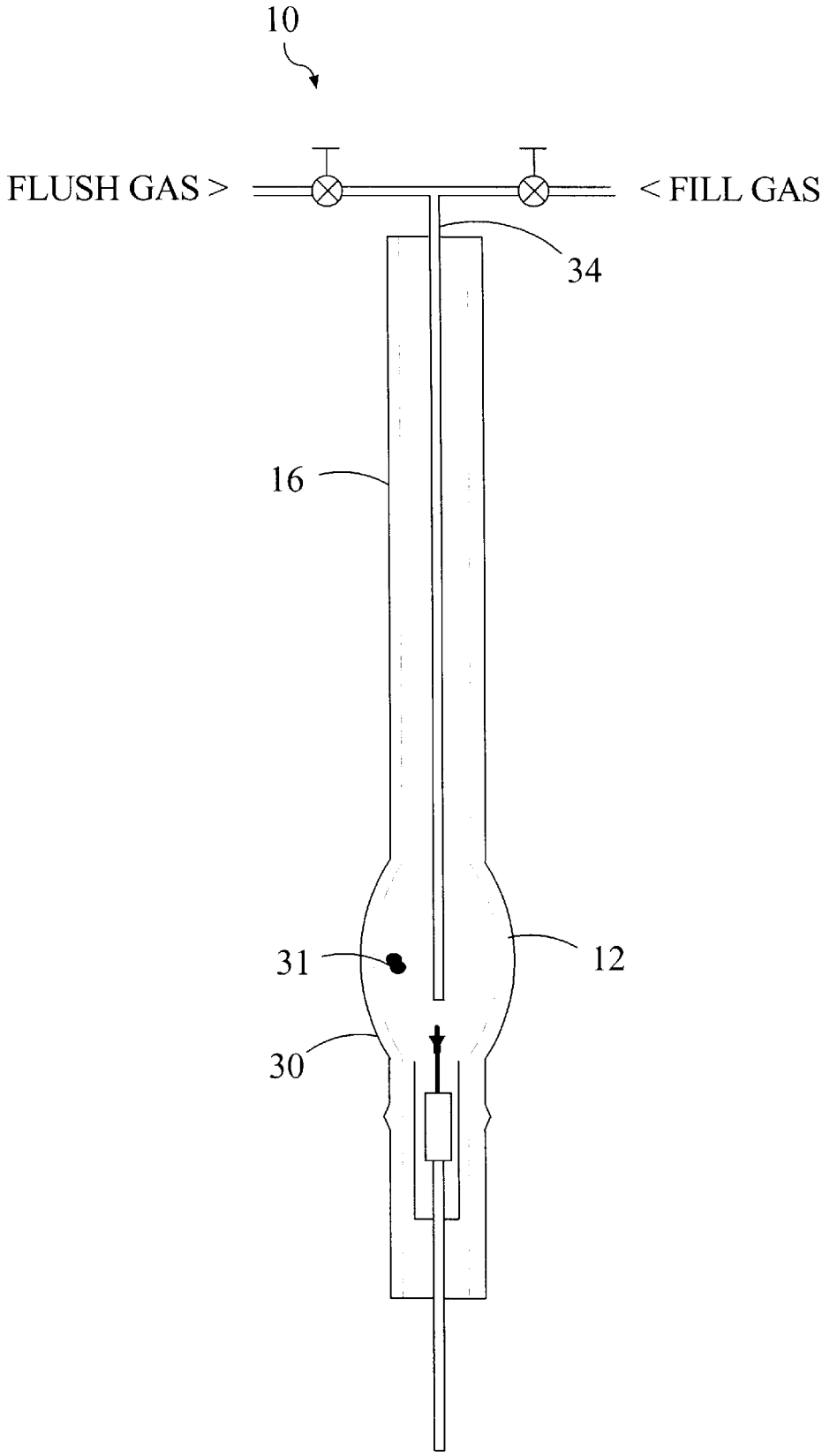
FIG. 5 illustrates the step of introducing the solid lamp fill material and mercury into the interior of the chamber.

The next step is to dose the arc tube body with the desired fill material by introducing the material into the chamber 12 through the remaining open end portion 16. The solid lamp fill material 30 may be introduced into the chamber 12 through the remaining open end portion 16 by any conventional means such as a pin type dispenser of lamp fill pellets manufactured by APL Engineered Materials, Inc. Mercury 31, if desired, may also be introduced into the chamber 12 through the end portion 16 by any conventional means. FIG. 5 illustrates an arc tube body 10 having lamp fill pellets 30 and mercury 31 within the chamber 12.

The remaining steps in the process include the flushing and filling of the chamber with the final fill gas, the positioning of the second electrode lead assembly in the remaining open end portion, and the sealing of the remaining open end portion. As discussed with respect to the pinch sealing of the first end portion, it is important to prevent the exposure of the metallic components of the electrode lead assembly to a corrosive atmosphere at high temperature.

Figure 6:
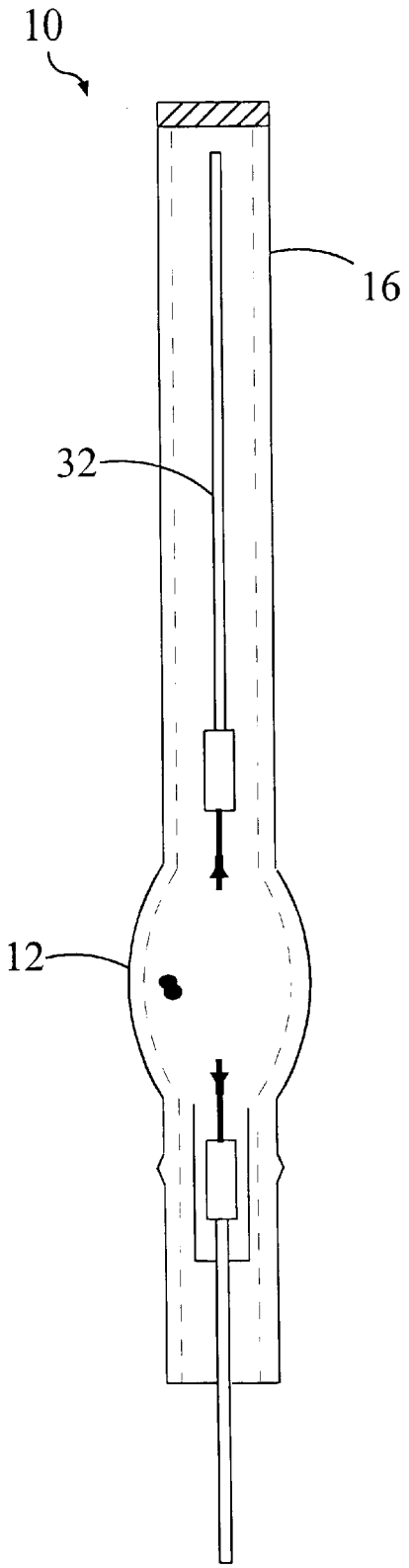
FIGURE 6 PRIOR ART
FIG. 6 is a cross-sectional view of a prior art arc tube body having its elongated end portion tipped off beyond the electrode lead assembly.

The prior art methods teach the necessity to isolate the components from an uncontrolled atmosphere by either (i) placing the arc tube body in a glove box, or (ii) connecting the open end of the arc tube body to a vacuum system prior to filling the interior of the arc tube body with the final fill gas and positioning the second electrode lead assembly. As shown in FIG. 6, the open end portion 16 may be fused closed outside the lead assembly 32 once the final fill pressure is obtained to isolate the interior of the chamber 12 containing an inert atmosphere. Thus the prior art prevents corrosion of the metallic components of the lead assembly during the pinch sealing of the end portion 16 by isolating the components in an inert atmosphere within the interior of the arc tube body.

Figure 7:
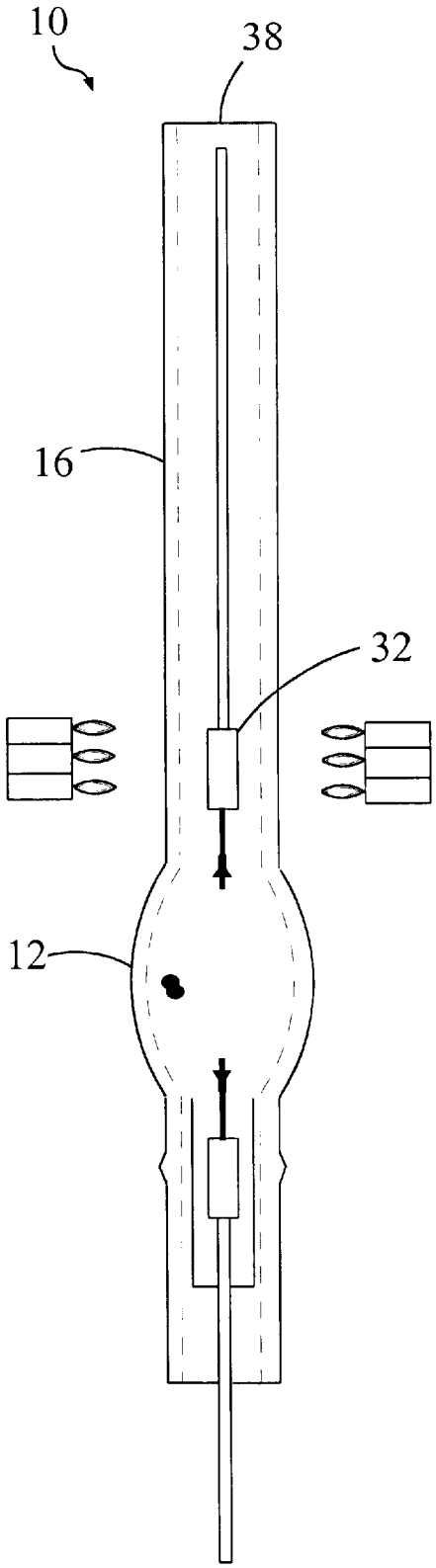
FIG. 7 illustrates the step of heating the upper end portion of an arc tube body while maintaining the interior of the body open to the surrounding atmosphere.

It has been discovered that the isolation of the interior of the arc tube from an uncontrolled atmosphere by use of a glove box or vacuum system may be obviated by orienting the arc tube body 10 so that the open end portion 16 extends upwardly as shown in FIGS. 5 and 7, and relying on the relative weight of the fill gas to air to maintain a fill of inert gas within the arc tube body. The final inert fill gas may be introduced into the interior of the chamber 12 by insertion of a suitable conventional probe 34. The fill gas may be any inert gas such as argon, neon, xenon, krypton, or a combination thereof. In the preferred embodiment of the invention, the fill gas comprises a mixture of argon and krypton. The mixture of argon and krypton is heavier than air and will tend to remain within the interior of the arc tube body 10 so long as the body remains in a substantially vertical orientation, thus retarding the influx of the lighter contaminated air of the uncontrolled atmosphere surrounding the arc tube.

The interior of the arc tube body 10 is flushed and filled with the fill gas to the tip 38 of the end portion 16 so that all other gases are displaced. Once the arc tube body is flushed and filled, the probe 34 may be removed and the second electrode lead assembly 32 is positioned within the end portion 16 as shown in FIG. 7. The end portion 16 must extend sufficiently above the lead assembly 32 so that the lead assembly 32 will remain immersed in the column of fill gas within the end portion 16 despite some mixing of the fill gas with the uncontrolled atmosphere surrounding the arc tube body near the tip 38 of the end portion 16.

Figure 8:
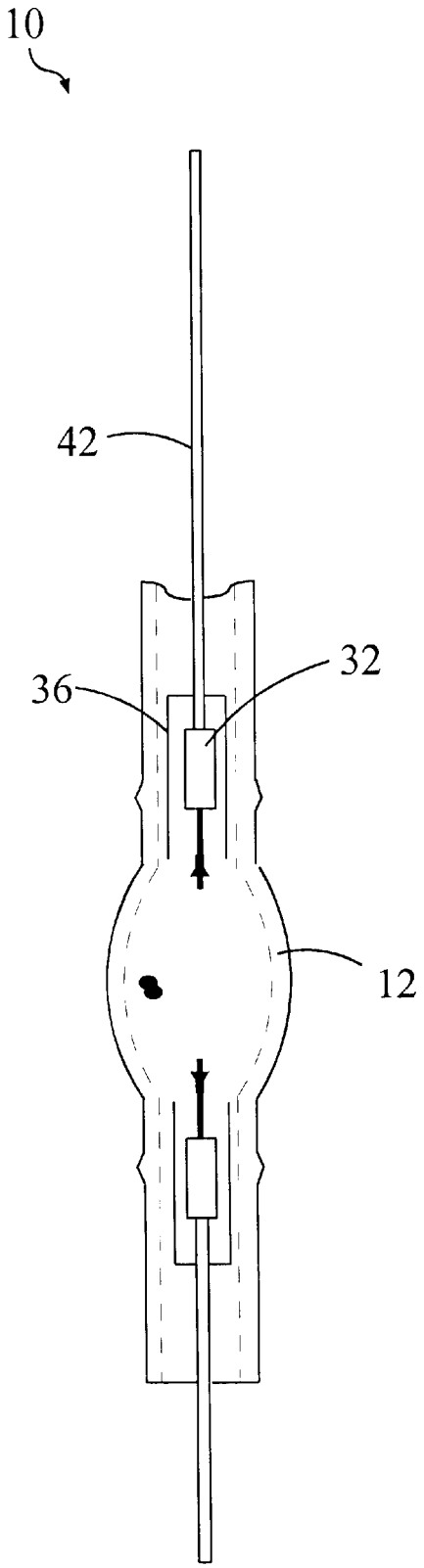
FIG. 8 is a cross-sectional view of an arc tube made by one method of the present invention.

As shown in FIGS. 7 and 8, the second end portion 16 may then be sealed by a conventional pinch sealing process. A portion of the end portion 16 is heated to soften the quartz, and then the softened portion is pressed together and around the portion of the electrode lead assembly 32 positioned therein using conventional pinch jaws (not shown) forming pinch seal 36. The pinch seal 36 fixes the position of the assembly 32 relative to the arc tube body 10 and provides a hermetic seal between the interior of the chamber 12 and the exterior of the body 10 through the end portion 16. In another embodiment, the end portion may be sealed by a shrink sealing process.

As further illustrated in FIG. 8, the chamber 12 is now hermetically sealed from the exterior of the arc tube body 10. The excess portion of the end portion 16 may then be removed to expose the outer lead 42 of the electrode lead assembly 32.

Figure 9:
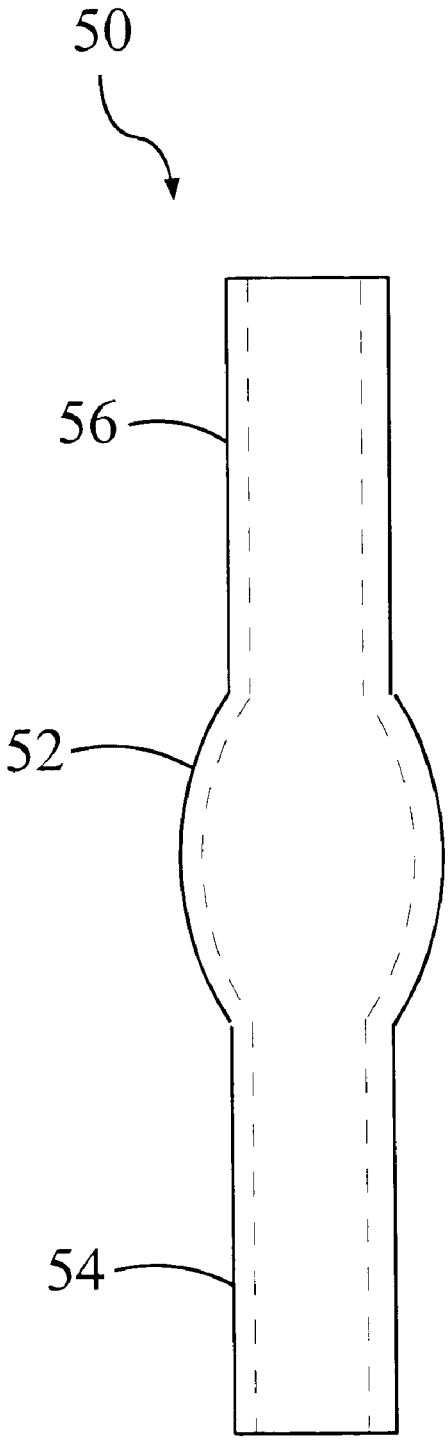
FIG. 9 is a cross-sectional view of one embodiment of an arc tube body according to the present invention.
Figure 10:
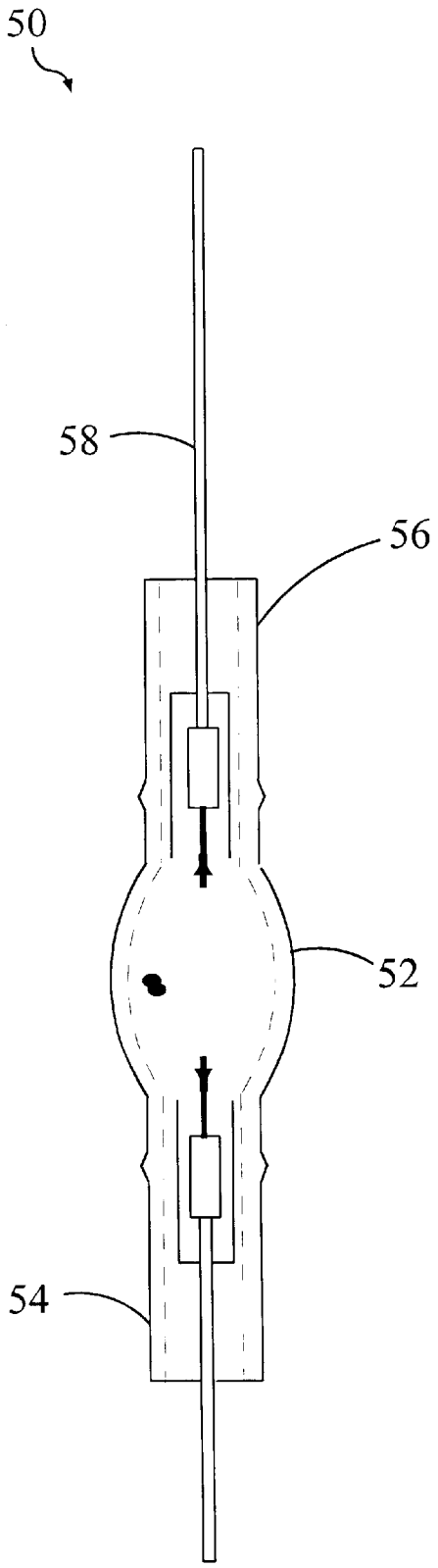
FIG. 10 is a cross-sectional view of an arc tube made from the arc tube body illustrated in FIG. 9.

FIGS. 9 and 10 illustrate another emdodiment of the present invention. The arc tube body 50 may be formed having a chamber 52 intermediate the open end portions 54,56. The end portions 54,56 may have substantially the same length. In the preferred embodiment, the length of the end portions 54,56 of the arc tube body 50 may be substantially the length of the end portions of the finished arc tube so that the step of trimming the excess portion of the second end portion once the chamber is sealed may be eliminated. However, it remains necessary to provide a column of fill gas which is sufficiently long so that the second electrode lead assembly 58 positioned within the second end portion 56 is completely immersed in fill gas during the pinch sealing process of the second end portion.

In one embodiment of the present invention, the column of fill gas may be extended beyond the length of the end portion by communication of the open end portion with a mechanical means forming an elongated shaft having substantially the same diameter as the outside diameter of the end portion. In the embodiment shown in FIGS. 11*a* and 11*b*, a flush and fill block 60 forms a main shaft 62 which communicates with the open end portion 56 of the arc tube body 50 during the steps of positioning the electrode lead assembly 58, flushing/filling the body 50 with the final fill gas, and pinch sealing the end portion 56.

Figure 11A:
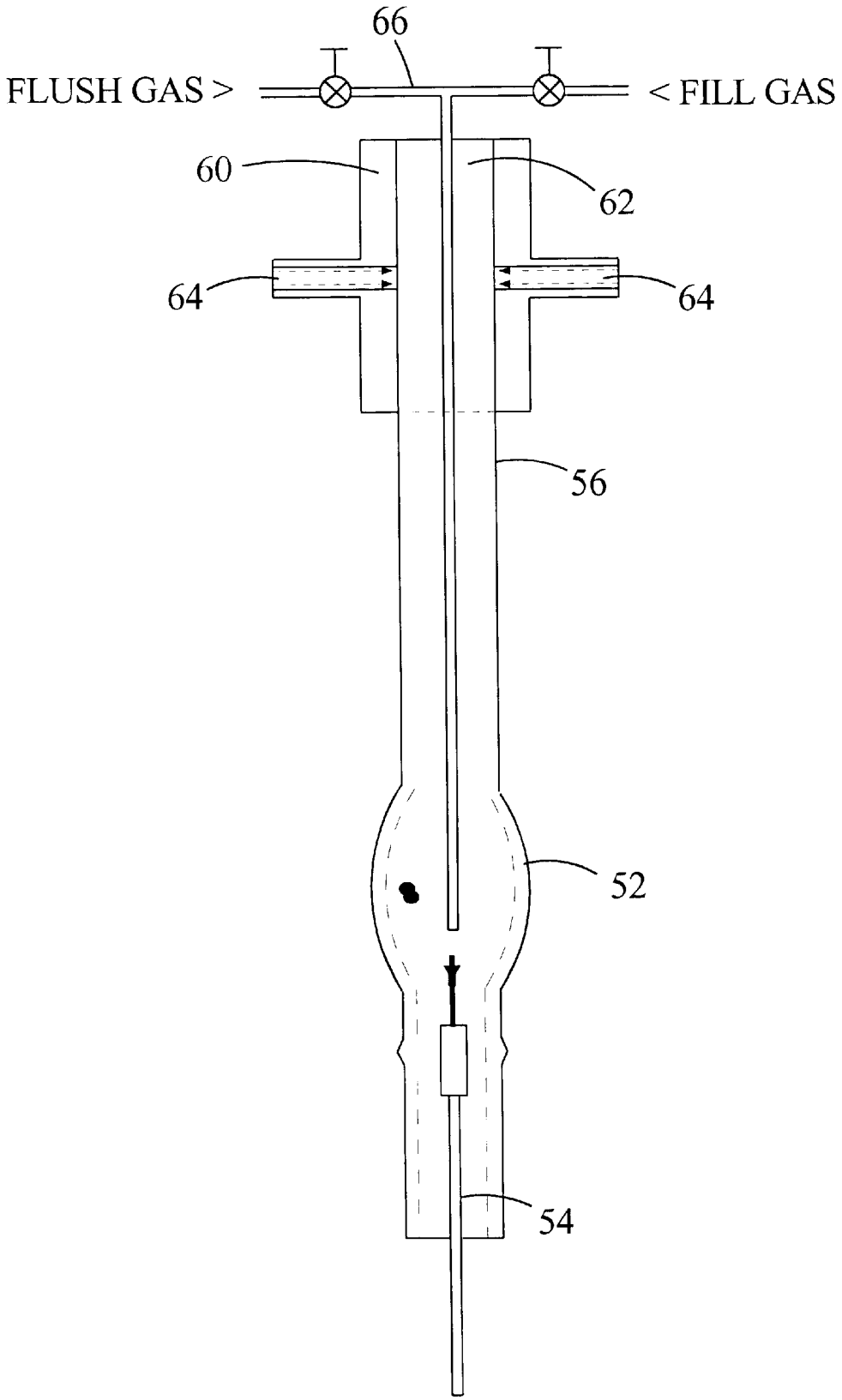
FIG. 11*a* illustrates the step of flushing and filling the arc tube body with the final fill gas according to the present invention.

The block 60 forms the main shaft 62 and one or more auxiliary shafts 64 which provide communication between the main shaft 62 and the surrounding atmosphere. The open end of the end portion 56 may be positioned relative to the block 60 to effect communication of the main shaft 62 with the tubular opening formed by the end portion 56. The interior of the arc tube chamber 52 and open end portion 56 may be flushed and filled with the final fill gas by insertion of a conventional probe 66 into the chamber 52 as shown in FIG. 11*a*.

Figure 11B:
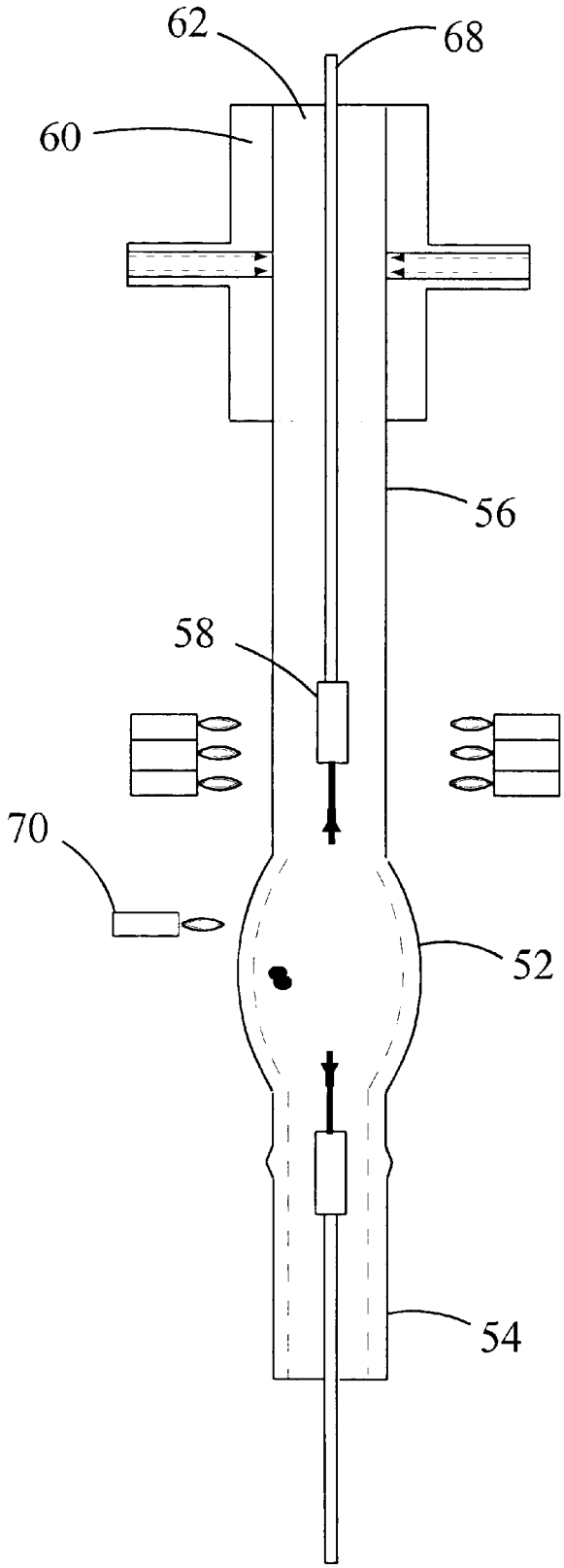
FIG. 11*b* illustrates the step of positioning the electrode lead assembly and pinch sealing the second end portion of the arc tube according to the present invention.

Once the arc tube body 50 is flushed and filled with the final fill gas, the probe 66 may be removed. The fill gas now fills the end portion 56 and the main shaft 62 and tends to remain within the shaft 62 as a result of the relative weight of the fill gas to the surrounding atmosphere. The electrode lead assembly 58 may then be positioned within the end portion 56 and main shaft 62 using a conventional assembly holder 68 as shown in FIG. 11*b*. With the fill gas filling the shaft 62 to the top, the electrode lead assembly 58 may be completely immersed in the fill gas to prevent corrosion during the pinch sealing process. Once the electrode lead assembly 58 is positioned, the end portion 56 may be pinch sealed using a conventional pinch seal process. In another embodiment, the end portion 56 may be sealed by a shrink seal process.

In many applications, it is desirable to provide an arc tube having a fill gas pressure which is significantly below atmospheric pressure at substantially room temperature, e.g., pressures lower than 500 torr. Arc tubes having fill gas pressure below one-half atmosphere and even as low as 30 torr are common. In order to obtain such subatmospheric fill gas pressures, the prior art methods use mechanical systems such as vacuum pumps to control the fill gas pressure prior to fusing closed the end portion and then pinch or shrink sealing the end portion to finally seal the chamber. Such mechanical systems are expensive and the process steps using such systems are difficult to automate.

In one aspect of the present invention, the use of such mechanical systems is obviated in providing significantly subatmospheric fill gas pressures in arc tubes. During the final pinch sealing process to hermetically seal the upper end portion 16,56, communication between the interior of the chamber 12,52 and the uncontrolled atmosphere surrounding the arc tube body 10,50 is maintained. Thus the pressures of the fill gas and surrounding atmosphere are the same and the fill gas may expand or contract responsive to the temperature of the fill gas relative to the temperature of the surrounding atmosphere. In order to obtain a significantly subatmospheric fill gas pressure at substantially room temperature, the arc chamber may be heated to thereby elevate the temperature of the fill gas during the pinch sealing process to thereby reduce the density of the fill gas within the chamber at the time the chamber is hermetically sealed. The pressure of the fill gas at the time the chamber is sealed will be equal to the pressure of the surrounding atmosphere because communication between the atmospheres is maintained during the sealing process. In the uncontrolled atmosphere of a factory production area, the pressure will be substantially atmospheric pressure and elevating the temperature of the fill gas will result in flow of fill gas from the arc tube through the open end portion to prevent contamination from the mixing of the gases at the end of the tube. When the arc tube and fill gas cools to room temperature, the pressure of the fill gas in the fixed volume of the chamber will be reduced and the final pressure of the fill gas at substantially room temperature may be controlled by controlling the temperature of the fill gas at the time the chamber is sealed.

In a preferred embodiment, a burner 70 applies direct heat to the bulbous chamber 52 of the arc tube body 50 during the pinch sealing process to control the temperature of the fill gas within the chamber 52. The intensity of the burner 70, and thus the amount of heat applied to the fill gas, may be controlled according to the desired fill gas pressure of the completed arc tube.

Alternatively, in another aspect of the invention, the fill gas may be cooled at the time the chamber is hermetically sealed to obtain a superatmospheric fill gas pressure at substantially room temperature. Care must be given to prevent contamination, e.g., by continuing to introduce fill gas into the arc tube during the cooling process.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of making an arc tube for a lamp comprising the steps of:

(a) providing an arc tube body comprising open tubular end portions;

(b) positioning the arc tube body so that the tubular end portions are substantially vertical;

(c) positioning a first electrode lead assembly in the lower open tubular end portion while flushing the interior of the body with an inert gas introduced through the upper open tubular end portion;

(d) hermetically sealing the lower tubular end portion and fixing the position of the first electrode lead assembly relative to the arc tube body by:

(i) heating a portion of the lower tubular end portion, and (ii) pinch-sealing the heated portion of the lower tubular end portion around the portion of the assembly positioned therein;

(e) introducing the lamp fill material into the interior of the arc tube body through the upper tubular end portion;

(f) flushing and filling the interior of the arc tube body with an inert fill gas through the upper tubular end portion;

(g) positioning a second electrode lead assembly in the upper tubular end portion; and (h) hermetically sealing the upper tubular end portion and fixing the position of the second electrode lead assembly relative to the arc tube body by:

(i) heating a portion of the upper tubular end portion while maintaining communication between the interior of the arc tube body and the atmosphere surrounding the arc tube body through the upper tubular end portion, and (ii) pinch-sealing the heated portion of the upper tubular end portion around the portion of the assembly positioned therein, the sealing of the upper end portion being the final seal to hermetically seal the interior of the arc tube body.

2. The method of claim 1 including the step of maintaining the pressure of the fill gas at substantially atmospheric pressure while modifying the temperature of the fill gas relative to the temperature of the atmosphere surrounding the arc tube body at the time the interior of the body is hermetically sealed so that the pressure of the fill gas will differ from the pressure of the surrounding atmosphere when the fill gas returns to the temperature of the surrounding atmosphere.

3. The method of claim 2 wherein the temperature of the fill gas is sufficiently elevated at the time the interior of the arc tube body is hermetically sealed so that the pressure of the fill gas will be substantially subatmospheric at the temperature of the surrounding atmosphere.

4. The method of claim 3 further comprising the step of heating the portion of the arc tube body between the tubular end portions while heating the upper tubular end portion during the step of hermetically sealing the upper tubular end portion to thereby elevate the temperature of the inert fill gas relative to the temperature of the surrounding atmosphere prior to pinch sealing the upper tubular end portion.

5. The method of claim 1 wherein the inert fill gas is heavier than the atmosphere surrounding the arc tube body to thereby reduce the mixing of the fill gas with the surrounding atmosphere during the sealing of the upper end portion.

6. The method of claim 5 further comprising the step of heating the portion of the arc tube body between the tubular end portions while heating the upper tubular end portion during the step of hermetically sealing the upper tubular end portion to thereby elevate the temperature of the inert fill gas relative to the temperature of the surrounding atmosphere to thereby effect flow of the fill gas out of the interior of the arc tube body during the step of pinch sealing the upper tubular end portion.

7. The method of claim 6 wherein the lamp fill material comprises one or more metal halides and the fill gas comprises one or more inert gases.

8. The method of claim 1 wherein the arc tube body comprises a bulbous light emitting chamber intermediate the tubular end portions.

9. The method of claim 1 wherein the tubular end portions have substantially the same length.

10. The method of claim 9 further comprising the step of extending the length of the upper tubular end portion beyond the electrode lead assembly positioned therein so that the electrode lead assembly is completely immersed in fill gas at the time the upper end portion is pinch sealed.

11. The method of claim 9 wherein the length of the end portions of the arc tube body is substantially the same as the length of the end portions of the sealed arc tube.

12. The method of claim 1 wherein the arc tube body is cylindrical.

13. The method of claim 1 wherein the lamp fill material comprises mercury and one or more metal halides and the fill gas comprises argon, xenon, or krypton or a mixture thereof.

14. The method of claim 13 wherein the lamp fill gas comprises argon and krypton.

15. A method of making an arc tube for a high intensity discharge lamp wherein the arc tube includes fill gas at subatmospheric pressure at substantially room temperature, said method comprising the steps of:

elevating the temperature of the fill gas in the interior of the arc tube body relative to the temperature of an uncontrolled atmosphere surrounding the body at substantially atmospheric pressure while maintaining communication between the fill gas and the surrounding atmosphere; and hermetically sealing the arc tube body while the temperature of the fill gas is elevated so that the pressure of the fill gas sealed within the interior of the arc tube will be subatmospheric when the temperature of the fill gas is no longer elevated.

16. The method of claim 15 further comprising the step of controlling the elevated temperature of the fill gas to obtain a desired fill gas pressure when the arc tube is sealed and the fill gas temperature is no longer elevated.

17. The method of claim 15 wherein the step of elevating the temperature of the fill gas comprises the step of heating the longitudinally central portion of the arc tube body.

18. The method of claim 15 comprising the steps of:

sealing one tubular end portion of the body;

sealing the other tubular end portion of the body to thereby form a hermetically sealed light emitting chamber between the sealed end portions; and heating the chamber to thereby elevate the temperature of the fill gas within the chamber during the step of sealing the other tubular end portion.

19. The method of claim 18 wherein the end portions are pinch-sealed.

20. The method of claim 18 wherein the end portions are shrink-sealed.

21. The method of claim 15 wherein the fill gas is inert and the surrounding atmosphere is air.

22. The method of claim 21 wherein the inert fill gas comprises argon.

23. The method of claim 15 wherein the pressure of the fill gas sealed within the chamber is below one-half atmosphere at substantially room temperature.

24. The method of claim 23 wherein the fill gas pressure is between about 30 torr and about 350 torr.

25. The method of claim 15 wherein the step of hermetically sealing the arc tube body comprises the step of sealing a tubulation extending from a light emitting chamber of the arc tube.

26. The method of claim 15 wherein the arc tube body comprises a light emitting chamber having a single open end.

27. The method of claim 15 wherein the arc tube body comprises ceramic material.

28. The method of claim 15 wherein the arc tube body comprises quartz.

29. The method of claim 15 wherein the step of hermetically sealing the arc tube body comprises the steps of positioning one or more electrode lead assemblies in an open end portion of the body, and sealing the end portion around the one or more electrode lead assemblies positioned therein to thereby fix the position of the one or more electrode lead assemblies and hermetically seal the arc tube body.

30. In a method of making an arc tube having a hermetically sealed light emitting chamber containing fill gas having a subatmospheric pressure at substantially room temperature, the improvement wherein no step is performed in a controlled atmosphere and wherein the subatmospheric fill gas pressure at substantially room temperature is obtained without mechanically evacuating the chamber.

31. A method of making an arc tube for a high intensity discharge lamp having fill gas hermetically sealed within the light emitting chamber of the arc tube wherein the pressure of the fill gas is less than one-half atmosphere at substantially room temperature, said method comprising the steps of:

elevating the temperature of the fill gas within the chamber to effect flow of fill gas from the chamber as a result of the elevated temperature thereof; and hermetically sealing the chamber after sufficient fill gas has flowed from the chamber so that the pressure of the fill gas sealed within the chamber will be less than one-half atmosphere when the temperature of the fill gas is no longer elevated.

32. The method of claim 31 wherein the fill gas flows from the chamber through an open tubular end portion of the arc tube.

33. The method of claim 31 wherein the arc tube comprises a pair of tubular end portions.

34. The method of claim 31 wherein the arc tube comprises a single end portion.

35. The method of claim 31 wherein the chamber is intermediate sealed end portions and the fill gas flows from the chamber through an open tubulation.

36. The method of claim 31 wherein the fill gas is inert and flows from the chamber into an uncontrolled atmosphere.

37. The method of claim 31 wherein the fill gas pressure at substantially room temperature is between about 30 torr and about 350 torr.

38. The method of claim 31 wherein the step of hermetically sealing the arc tube body comprises the steps of positioning one or more electrode lead assemblies in an open end portion of the body, and sealing the end portion around the one or more electrode lead assemblies positioned therein to thereby fix the position of the one or more electrode lead assemblies and hermetically seal the arc tube body.

39. In a method of making an arc tube having sealed light emitting chamber containing fill gas having a pressure of less than one-half atmosphere at substantially room temperature, the improvement wherein the subatmospheric fill gas pressure is obtained without the step of mechanically evacuating the chamber.

40. A method of making an arc tube for a high intensity discharge lamp having a hermetically sealed light emitting chamber intermediate a pair of tubular end portions and a fill gas sealed within the chamber, said method comprising the steps of:

flushing and filling the interior of the chamber with fill gas through an open tubular end portion; and hermetically sealing the chamber by pinch-sealing the open end portion while maintaining communication between the fill gas and an uncontrolled atmosphere surrounding the arc tube through the end portion until the chamber is sealed.

41. The method of claim 40 further comprising the step of positioning the arc tube so that the open tubular end portion extends upward during the steps of flushing and filling and sealing the chamber.

42. The method of claim 40 wherein the fill gas is inert and the atmosphere surrounding the arc tube is air.

43. The method of claim 40 wherein the arc tube comprises quartz.

44. A method of making an arc tube for a high intensity discharge lamp having a hermetically sealed light emitting chamber intermediate a pair of tubular end portions and a fill gas sealed within the chamber, said method comprising the steps of:

positioning the arc tube so that an open tubular end portion extends upward;

flushing and filling the interior of the chamber with fill gas through the upwardly extending open tubular end portion, the fill gas being heavier than the atmosphere surrounding the arc tube; and hermetically sealing the chamber by pinch-sealing the open end portion while maintaining communication between the fill gas and the atmosphere surrounding the arc tube through the upwardly extending end portion until the chamber is sealed.

45. The method of claim 44 wherein the fill gas is inert and the atmosphere surrounding the arc tube is air.

46. The method of claim 44 wherein the fill gas comprises argon or xenon.

47. In a method of making an arc tube for an arc discharge lamp including the steps of filling the arc tube with inert fill gas through an open tubular end portion thereof and then forming a pinch seal in the end portion to thereby hermetically seal the arc tube, the improvement comprising the step of maintaining the interior of the arc tube open to the atmosphere surrounding the arc tube through the tubular end portion until the pinch seal is formed, the atmosphere surrounding the arc tube at the time the pinch seal is formed being an uncontrolled atmosphere.

48. In a method of making an arc tube comprising the steps of filling a light emitting chamber with fill gas and then sealing the chamber, the improvement wherein communication between the fill gas within the chamber and an uncontrolled atmosphere surrounding the chamber is maintained until the chamber is sealed.

49. The method of claim 48 further including the step of elevating the temperature of the fill gas within the chamber relative to the surrounding atmosphere to thereby effect a flow of fill gas out of the chamber during the sealing thereof.

50. The method of claim 49 wherein the pressure of the fill gas within the sealed arc tube is subatmospheric at substantially room temperature.

51. The method of claim 48 wherein the fill gas is inert and the atmosphere surrounding the arc tube is air.

52. The method of claim 48 wherein the fill gas is introduced into the light emitting chamber through an open end portion of the arc tube.

53. The method of claim 48 wherein the fill gas is introduced into the light emitting chamber through an open fill tube.

54. A method of making a tipless arc tube having a hermetically sealed light emitting chamber containing a fill gas, said method comprising the steps of:

placing the tipless chamber in a gaseous atmosphere;

flushing and filling the chamber with the fill gas through an open end portion of the arc tube; and hermetically sealing the chamber by sealing the end portion while maintaining communication of the fill gas through the end portion with the gaseous atmosphere surrounding the arc tube, the composition of the fill gas being different from the composition of the gaseous atmosphere surrounding the arc tube.

55. The method of claim 54 wherein the gaseous atmosphere is air and the fill gas is inert.

56. The method of claim 54 wherein the gaseous atmosphere is non-reactive and the fill gas is inert.

57. The method of claim 54 wherein the step of hermetically sealing the chamber comprises the step of pinch-sealing the end portion.

58. The method of claim 54 wherein the step of hermetically sealing the chamber comprises the step of shrink-sealing the end portion.

59. The method of claim 54 wherein the open end portion of the arc tube extends substantially upward and the fill gas is heavier than the gaseous atmosphere.

60. A method of making an arc tube in a first atmosphere including the steps of introducing the lamp fill gas into the interior of the arc tube chamber through an open end portion of the arc tube and then forming a seal in the end portion to thereby hermetically seal the arc tube chamber from the first atmosphere while maintaining communication between the fill gas and the first atmosphere until the seal is formed, the composition of the first atmosphere surrounding the arc tube being different than the composition of the fill gas.

61. The method of claim 60 wherein the fill gas is non-reactive and the first atmosphere is reactive.

62. The method of claim 61 wherein the fill gas is inert and the first atmosphere is air.

63. The method of claim 60 wherein the fill gas is non-reactive and the first atmosphere is non-reactive.

64. The method of claim 63 wherein the fill gas is inert.

65. The method of claim 64 wherein the first atmosphere is inert.

66. The method of claim 60 wherein the arc tube is double ended.

67. The method of claim 60 wherein the arc tube is single ended.

68. A method of making an arc tube comprising the steps of:

(a) providing an arc tube body comprising an arc tube chamber intermediate open tubular end portions, the interior of the chamber being open to the atmosphere only through the end portions;

(b) positioning a first electrode lead assembly in one of the end portions;

(c) pinch sealing the end portion around a portion of the first electrode lead assembly positioned therein to thereby fix the position of the assembly relative to the arc tube body and to provide a hermetic seal between the end portion and the first electrode lead assembly;

(d) introducing solid lamp fill material, mercury, and an inert fill gas into the arc tube chamber through the other end portion;

(e) positioning a second electrode lead assembly in the other end portion;

(f) pinch sealing the other end portion around a portion of the second electrode lead assembly positioned therein to thereby fix the position of the assembly relative to the arc tube body and to hermetically seal the arc tube chamber while maintaining communication between the chamber and an uncontrolled atmosphere surrounding the arc tube through the other end portion until the chamber is hermetically sealed.

69. A method of making a tipless arc tube comprising the steps of:

(a) providing an arc tube body comprising a bulbous light emitting chamber intermediate open tubular end portions, the chamber being open to the exterior of the arc tube body only through the end portions;

(b) positioning an electrode lead assembly into one of the open tubular end portions;

(c) flowing an inert gas past the electrode lead assembly;

(d) pinch sealing the tubular end portion around the electrode lead assembly positioned therein while the inert gas is flowing thereby;

(e) dosing solid lamp fill material into the interior of the chamber through the remaining open tubular end portion of the arc tube body;

(f) dosing mercury into the interior of the chamber through the remaining open tubular end portion of the arc tube body;

(g) discharging fill gas into the chamber through the remaining open tubular end portion to thereby displace all other gasses from the chamber;

(h) positioning a second electrode lead assembly into the remaining open tubular end portion;

(i) controlling the temperature of the fill gas within the chamber to thereby control the density of the fill gas to be hermetically sealed within the chamber; and (j) pinch sealing the remaining open tubular end portion around the electrode lead assembly positioned therein to thereby hermetically seal the chamber.

70. The method of claim 69 wherein the pressure of the fill gas sealed within the chamber is subatmospheric at substantially room temperature.

71. The method of claim 69 wherein the pressure of the fill gas sealed within the chamber is superatmospheric at substantially room temperature.

72. The method of claim 69 wherein the arc tube body is positioned so that the remaining open tubular end portion extends upward and the fill gas is heavier than the atmosphere surrounding the arc tube.

73. The method of claim 69 wherein the arc tube body is positioned so that the remaining open tubular end portion extends downward and the fill gas is lighter than the atmosphere surrounding the arc tube.

74. In a method of making an arc tube including the steps of introducing lamp fill gas into the interior of the arc tube chamber through an open tubular end portion of the arc tube and then forming a seal in the end portion to thereby hermetically seal the arc tube chamber from the surrounding atmosphere wherein the pressure of the fill gas sealed within the chamber is less than one-half atmosphere at substantially room temperature, the improvement wherein there is no pressure differential between the pressure of the fill gas and the pressure of the atmosphere surrounding the arc tube at the time the chamber is sealed.

75. The method of claim 74 wherein the pressure of the atmosphere surrounding the arc tube body at the time the chamber is sealed is substantially atmospheric pressure.

76. The method of claim 74 wherein the surrounding atmosphere is an uncontrolled atmosphere.

77. A method of making an arc tube for a high intensity discharge lamp having a hermetically sealed light emitting chamber intermediate a pair of tubular end portions and a fill gas sealed within the chamber, said method comprising the steps of:

flushing and filling the interior of the chamber with fill gas through an open tubular end portion; and hermetically seal the chamber by heating a portion of open tubular end portion with a flame while maintaining communication between the fill gas and the atmosphere surrounding the arc tube through the open end portion and compressing the heated portion to thereby form a hermetic seal in the end portion.

78. The method of claim 77 wherein the atmosphere surrounding the arc tube is an uncontrolled atmosphere.

79. The method of claim 77 wherein the arc tube is positioned so that the open end portion extends upwardly, and wherein the fill gas is heavier than the atmosphere surrounding the arc tube.

* * * * *

UNITED STATES PATENT AND TRADEMARK OFFICE

CERTIFICATE OF CORRECTION

PATENT NO. : 6,612,892 B1
DATED : September 2, 2003
INVENTOR(S) : Lamouri et al.

It is certified that error appears in the above-identified patent and that said Letters Patent is hereby corrected as shown below:

Title page,
Item [57], ABSTRACT,
Line 1, ends "hermetically scaling the arc tube." and should read -- hermetically sealing the arc tube. --

Column 2,
Line 22, reads "During the pinch sealing process, anon-reactive gas is introduced..." and should read -- During the pinch sealing process, a non-reactive gas is introduced... --

Signed and Sealed this

Thirtieth Day of December, 2003

JAMES E. ROGAN
*Director of the United States Patent and Trademark Office*